US008917215B2

(12) United States Patent
Pohl

(10) Patent No.: US 8,917,215 B2
(45) Date of Patent: Dec. 23, 2014

(54) DIELECTRIC ANTENNA WITH AN ELECTROMAGNETIC FEED ELEMENT AND WITH AN ELLIPSOIDAL LENS MADE OF A DIELECTRIC MATERIAL

(75) Inventor: Nils Pohl, Bochum (DE)

(73) Assignee: KROHNE Messtechnik GmbH & Co. KG, Duisburg (DE)

( * ) Notice: Subject to any disclaimer, the term of this patent is extended or adjusted under 35 U.S.C. 154(b) by 645 days.

(21) Appl. No.: 12/866,908

(22) PCT Filed: Feb. 11, 2009

(86) PCT No.: PCT/EP2009/000948

§ 371 (c)(1),
(2), (4) Date: Aug. 10, 2010

(87) PCT Pub. No.: WO2009/100891

PCT Pub. Date: Aug. 20, 2009

(65) Prior Publication Data

US 2010/0321262 A1 Dec. 23, 2010

(30) Foreign Application Priority Data

Feb. 11, 2008 (DE) ..... 10 2008 008 715

(51) Int. Cl.

| | |
|---|---|
| ***H01Q 19/08*** | (2006.01) |
| ***H01Q 19/09*** | (2006.01) |
| ***H01Q 13/06*** | (2006.01) |
| ***H01Q 15/08*** | (2006.01) |

(52) U.S. Cl.

CPC ..... *H01Q 19/09* (2013.01); *H01Q 13/06* (2013.01); *H01Q 15/08* (2013.01)

USPC ..... 343/753; 343/785

(58) Field of Classification Search

CPC ..... H01Q 13/06–13/065; H01Q 15/02; H01Q 15/08

USPC ..... 343/753–754, 785

See application file for complete search history.

(56) References Cited

U.S. PATENT DOCUMENTS 4,989,007 A * 1/1991 Coffey et al. ..... 342/11
5,166,698 A 11/1992 Ashbaugh et al.

(Continued)

FOREIGN PATENT DOCUMENTS

FR 2 838 245 A1 10/2003
GB 1127274 9/1968

(Continued)

OTHER PUBLICATIONS

Neto, A.; Maci, S.; de Maagt, P.J.I.; , "Reflections inside an elliptical dielectric lens antenna," Microwaves, Antennas and Propagation, IEE Proceedings , vol. 145, No. 3, pp. 243-247, Jun. 1998.*

*Primary Examiner* — Robert Karacsony
*Assistant Examiner* — Amal Patel
(74) *Attorney, Agent, or Firm* — Roberts Mlotkowski Safran & Cole, P.C.; David S. Safran

(57) ABSTRACT

A dielectric antenna with an electromagnetic feed element (2) and with a lens (3) made of a dielectric material, the feed element (2) emitting electromagnetic radiation (4) and the lens (3) being supplied with electromagnetic radiation (4) in the feed region (5), the lens (3) relaying the electromagnetic radiation (4) and radiating it with the transmission region (6). To configure these dielectric antennas such that the disadvantages of the dielectric antennas known from the prior art are at least partially avoided, first of all, the lens (3) is shaped essentially ellipsoidally at least in the transmission region (6) and the lens (3) is arranged relative to the feed element (2) such that the electromagnetic radiation (4) emitted by the lens (3) in the direction of maximum radiation (7) of the antenna has an essentially planar phase front.

4 Claims, 4 Drawing Sheets

(56) References Cited

U.S. PATENT DOCUMENTS

| | | | | |
|---|---|---|---|---|
| 5,859,615 | A * | 1/1999 | Toland et al. | 343/753 |
| 6,023,246 | A | 2/2000 | Tanabe | |

FOREIGN PATENT DOCUMENTS

| | | | |
|---|---|---|---|
| WO | 91/15879 | A1 | 10/1991 |
| WO | 2007/136289 | A1 | 11/2007 |

* cited by examiner

DIELECTRIC ANTENNA WITH AN ELECTROMAGNETIC FEED ELEMENT AND WITH AN ELLIPSOIDAL LENS MADE OF A DIELECTRIC MATERIAL

BACKGROUND OF THE INVENTION

1. Field of the Invention

The invention relates to a dielectric antenna with an electromagnetic feed element and with a lens made of a dielectric material, the feed element emitting electromagnetic radiation and the lens in the feed region being supplied with electromagnetic radiation, the lens relaying the electromagnetic radiation and emitting it with the transmission region.

2. Description of Related Art

Dielectric antennas are known from various fields of engineering in quite varied types of construction. However, it is common to dielectric antennas that dielectric materials, especially those dielectric materials which have especially low losses, are used to guide and radiate electromagnetic waves. For example, using polytetraflouroethylene or polypropylene as the dielectric material or other dielectrics with low permittivity for the lens is known.

In industrial process engineering, dielectric antennas are often used, for example, for level measurement. In these and also other applications, it is especially advantageous if the antennas used have a direction of maximum radiation as narrow as possible, and at the same time, a type of construction as compact as possible. However, these requirements are contradictory with respect to the mechanical measures which must be conventionally taken for their technical implementation. A narrow directional characteristic in the direction of maximum radiation can be achieved only by a large aperture—i.e., opening area—of the transmission region of the lens, as is recognized. So that the aperture is also used for purposes of a narrow direction of maximum radiation, the electromagnetic radiation emitted from the transmission region of the lens must have a phase front as planar as possible, and this planar phase front can be implemented more easily with increasing length of the antenna; likewise, this opposes the desired compact type of construction.

Known dielectric antennas, in addition to difficult simultaneous implementation of a narrow direction of maximum radiation with a simultaneously compact type of construction, have a further disadvantage which is related to the mutual arrangement of the electromagnetic feed element and the lens made of dielectric material. For types of antenna construction in which the electromagnetic feed element and the lens are in direct contact with one another, the lens is surrounded at least by parts of the electromagnetic feed element, as a result of which the dielectric lens necessarily projects into the electromagnetic feed element and is exposed to electromagnetic radiation in the feed element (U.S. Pat. No. 6,023,246).

For other types of construction, the electromagnetic feed element and the lens made of dielectric material are arranged spaced apart from one another so that an intermediate space arises between the electromagnetic feed element and the dielectric lens.

The two aforementioned versions have the disadvantage that a type of construction which is also suitable, for example, for hygiene applications can only be poorly implemented. Aside from the implementation of an antenna with a lens which is at least partially encompassed by the feed element, which implementation is mechanically very demanding anyway, this type of construction also has the disadvantage that the transition from the feed element to the lens is in a region of the antenna that is shifted far forward and is comparatively exposed, and therefore, susceptible to dirt. In an antenna construction with intermediate spaces between the electromagnetic feed element and the lens, there is always the danger of fouling of those antenna surfaces which face the intermediate space; furthermore, overpressure and underpressure applications can be a problem as a result of the existing intermediate space.

SUMMARY OF THE INVENTION

Therefore, the object of this invention is to at least partially avoid the above indicated disadvantages of the known dielectric antennas.

This object is achieved in accordance with the invention, first of all, essentially in the dielectric antenna under consideration, in that the lens is shaped ellipsoidally at least in the transmission region and the lens is arranged relative to the feed element such that the electromagnetic radiation emitted by the lens in the direction of maximum radiation of the antenna has an essentially planar phase front. It has been ascertained that ellipsoidally shaped dielectric lenses enable a very short type of construction with simultaneous generation of emitted electromagnetic radiation which has essentially a planar phase front in the direction of maximum radiation.

In one preferred configuration of the invention, the dielectric lens is axisymmetrical to the major axis of the ellipsoid defined by the at least ellipsoidally shaped transmission region of the lens, the major axis of the ellipsoid then pointing essentially in the direction of maximum radiation of the antenna. Here, as is conventional in geometry, the major axis of an ellipsoid or the major axis of an ellipse is defined as the longitudinal axis of the ellipsoid or the ellipse, therefore that axis on which the focal points of the ellipsoid or the ellipse lie. These asymmetrical lenses are even rotationally symmetrical and therefore can be produced and installed especially easily.

In other preferred configurations of the dielectric antennas, the major axes of several ellipses defined by the at least ellipsoidally shaped transmission region are aligned essentially coaxially, it having been found to be especially advantageous if the ellipses have one focal point essentially in common. A lens configured in this way need no longer be rotationally symmetrical, rather can have a plurality of other shapes and symmetries, but each cutting plane which runs through the major axis leading through the lens to an elliptical cutting surface, the major axes of all these ellipses being aligned essentially coaxially, essentially therefore lying on top of one another.

If it is stated that ellipses have one focal point essentially in common, this means mainly those configurations in which the second focal points of all ellipses, which points do not lie essentially on or in one another, proceeding from the common focal point of the ellipses, cannot be found in different directions, but collectively in the direction of maximum radiation or collectively opposite the direction of maximum radiation of the antenna.

In one especially preferred configuration of the invention, the electromagnetic feed element is located essentially at the focal point of the ellipsoid defined by the at least ellipsoidally shaped transmission region of the lens, or the electromagnetic feed element is located essentially at the common focal point of the ellipses defined by the at least ellipsoidally shaped transmission region of the lens. It has been ascertained that a dielectric antenna which follows this preferred construction principle is especially well suited to producing an essentially planar phase front in the direction of maximum radiation.

The arrangement of the electromagnetic feed element at one focal point or the common focal point of the lens is especially preferred such that the electromagnetic feed element—to the extent it itself has one radiation direction—emits its electromagnetic radiation in the ultimately achieved direction of maximum radiation of the entire dielectric antenna. This means that the electromagnetic feed element is on the major axis or on the coaxial major axes of the lens with the at least ellipsoidally shaped transmission region.

In another preferred configuration of the invention, the electromagnetic feed element comprises an electromagnetic radiation source and a hollow conductor, the electromagnetic radiation emitted by the radiation source being routed from the hollow conductor to the lens, the hollow conductor being located especially coaxially to the major axis of the lens. In this electromagnetic feed element implemented with a hollow conductor, the feed element automatically has a distinct preferred direction with respect to radiation of electromagnetic waves so that what was stated with respect to the lens and to the direction of maximum radiation for the arrangement of the electromagnetic feed element applies especially here.

A configuration of the dielectric antenna in accordance with the invention is especially important in which the lens is attached to the outside of the electromagnetic feed element, especially to the outside of the hollow conductor, especially at least partially surrounds the outside of the electromagnetic feed element or of the hollow conductor, especially is plugged or screwed onto the electromagnetic feed element or onto the hollow conductor. This mechanical measure has several advantages over known constructions from the prior art.

On the one hand, in this way, very good encapsulation of the antenna is implemented altogether so that the dielectric antenna is also suitable for applications which have especially high demands with respect to attainable hygiene, such as, for example, applications in the food industry. Because the lens surrounds the electromagnetic feed element and the hollow conductor, the number of intermediate spaces and transition sites between the lens and electromagnetic feed element is minimized.

On the other hand, due to the shape of the dielectric lens and as a result of the lack of metallic jacketing of the lens altogether, an effective aperture is achieved which is larger than the antenna aperture perceived only by projection of the transmission region of the lens in the direction of maximum radiation, so that the dielectric antenna in accordance with the invention achieves greater gain than, for example, a horn radiator of the same size. In addition, the open structure which, different from a rod radiator, does not form a waveguide, provides for repeated reflections of the impulse response decaying rapidly.

In another preferred configuration of the dielectric antenna, the lens is made ellipsoidal essentially beginning with its feed region in the direction of maximum radiation and the lens is made spout-shaped essentially beginning with its feed region opposite the direction of maximum radiation, specifically to accommodate the feed element and the hollow conductor. This configuration of the lens and the arrangement of the feed element and of the hollow conductor relative to the lens is especially suited for achieving high gain, for reasons of geometry-wave optics.

The spout can be made essentially in any shape and can be configured such that it is especially suitable, for example, for attaching the dielectric antenna. Preferably, the part of the lens which is made spout-shaped encapsulates the antenna on the process side, especially by the part which is made spout-shaped essentially completely surrounding the electromagnetic feed element, especially also by the part made spout-shaped essentially surrounding the mounting elements of the antenna on the process side. If the lens "part made spout-shaped" is addressed here, not only is a "classic" spout which is therefore made cylindrical, but rather the aforementioned indicates that it can be a matter of any throat of the dielectric antenna which at least partially surrounds the electrical and/or mechanical access of the electromagnetic feed source and the radiation source and add-on pieces.

In another preferred configuration of the antenna, the lens is made ellipsoidal except for the access region of the electromagnetic feed element.

For one skilled in the art, it is easily understandable that all properties in accordance with the invention which are described with respect to the attachment of the lens to the outside of the electromagnetic feed element or to the outside of the hollow conductor are equally well suited to lenses which are not made ellipsoidal in their transmission region, rather can have any shape. The advantages associated with the type of attachment of the lens to the electromagnetic feed element are independent of the shape of the lens.

In particular, there is now a plurality of possibilities for embodying and developing the antenna in accordance with the invention. In this respect reference is made the following detailed description of exemplary embodiments in conjunction with the accompanying drawings.

DETAILED DESCRIPTION OF THE INVENTION

Figure 1:
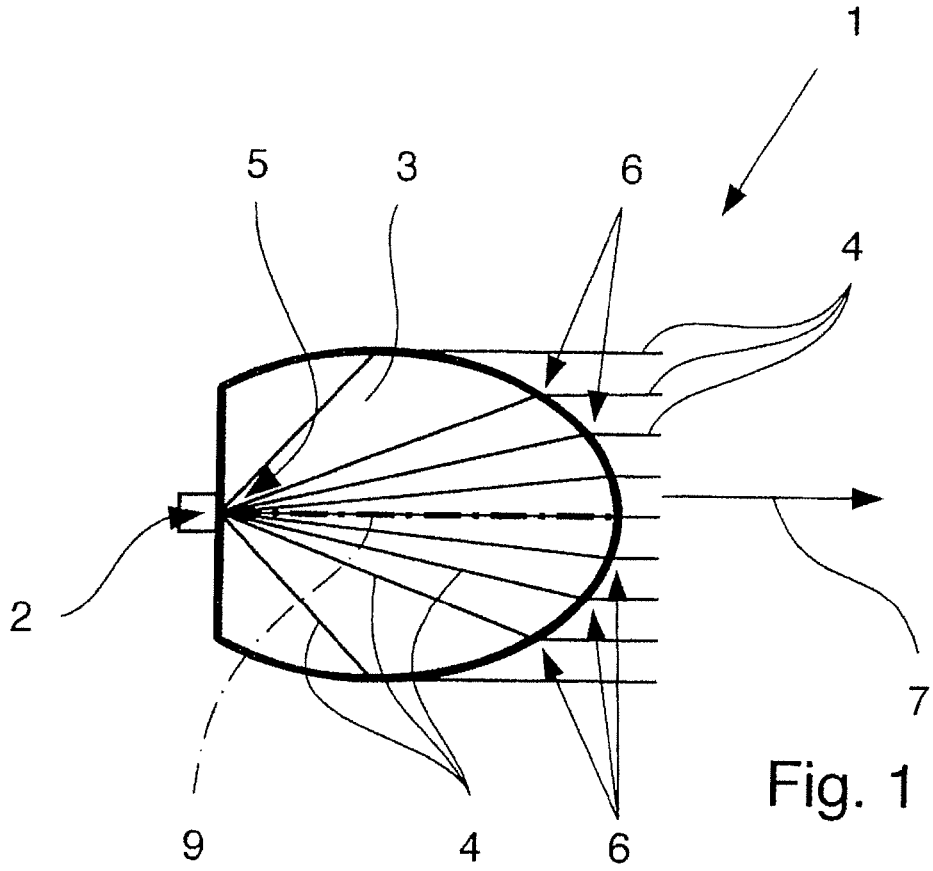
FIG. 1 schematically shows a cross section through a dielectric antenna in accordance with the invention with the sketched beam path of the electromagnetic radiation.

FIGS. 1 to 7 show a dielectric antenna 1 with an electromagnetic feed element 2 and with a lens 3 made of a dielectric material. The manner of operation of the antenna 1 is always based on the feed element 2 emitting electromagnetic radiation 4 and the lens 3 being supplied with electromagnetic radiation 4 in the feed region 5, the lens 3 relaying the electromagnetic radiation 4 and emitting it with the transmission region 6 of the lens.

Figure 2:
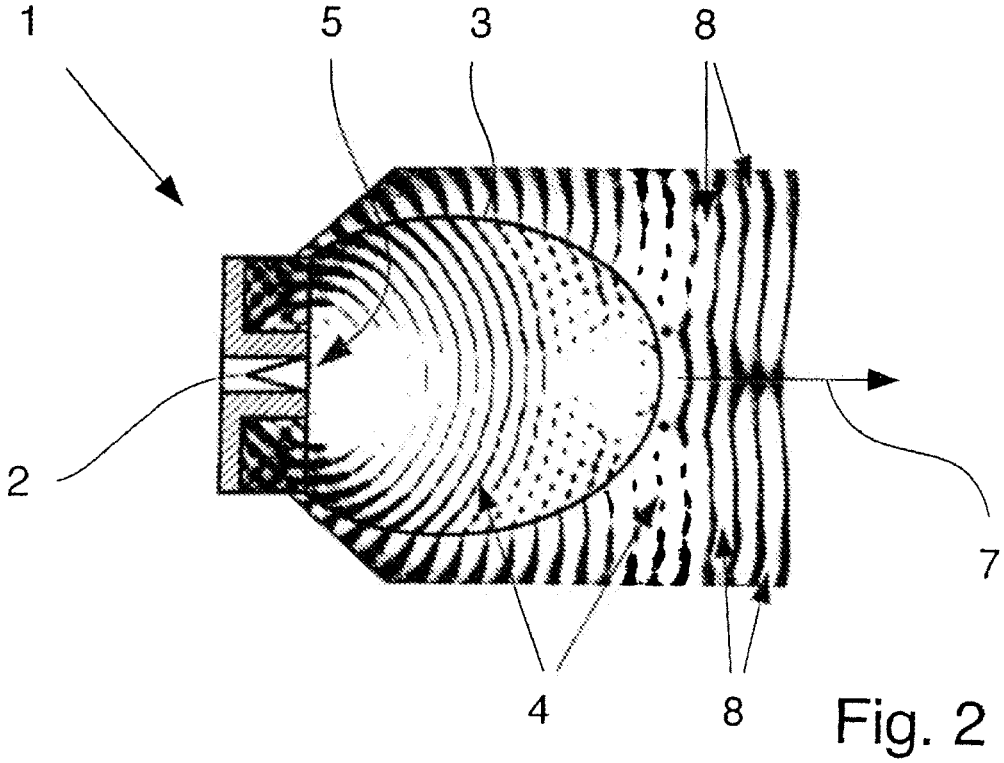
FIG. 2 shows a simulation of the electromagnetic field distribution inside and outside the lens of the dielectric antenna shown in FIG. 1.
Figure 3:
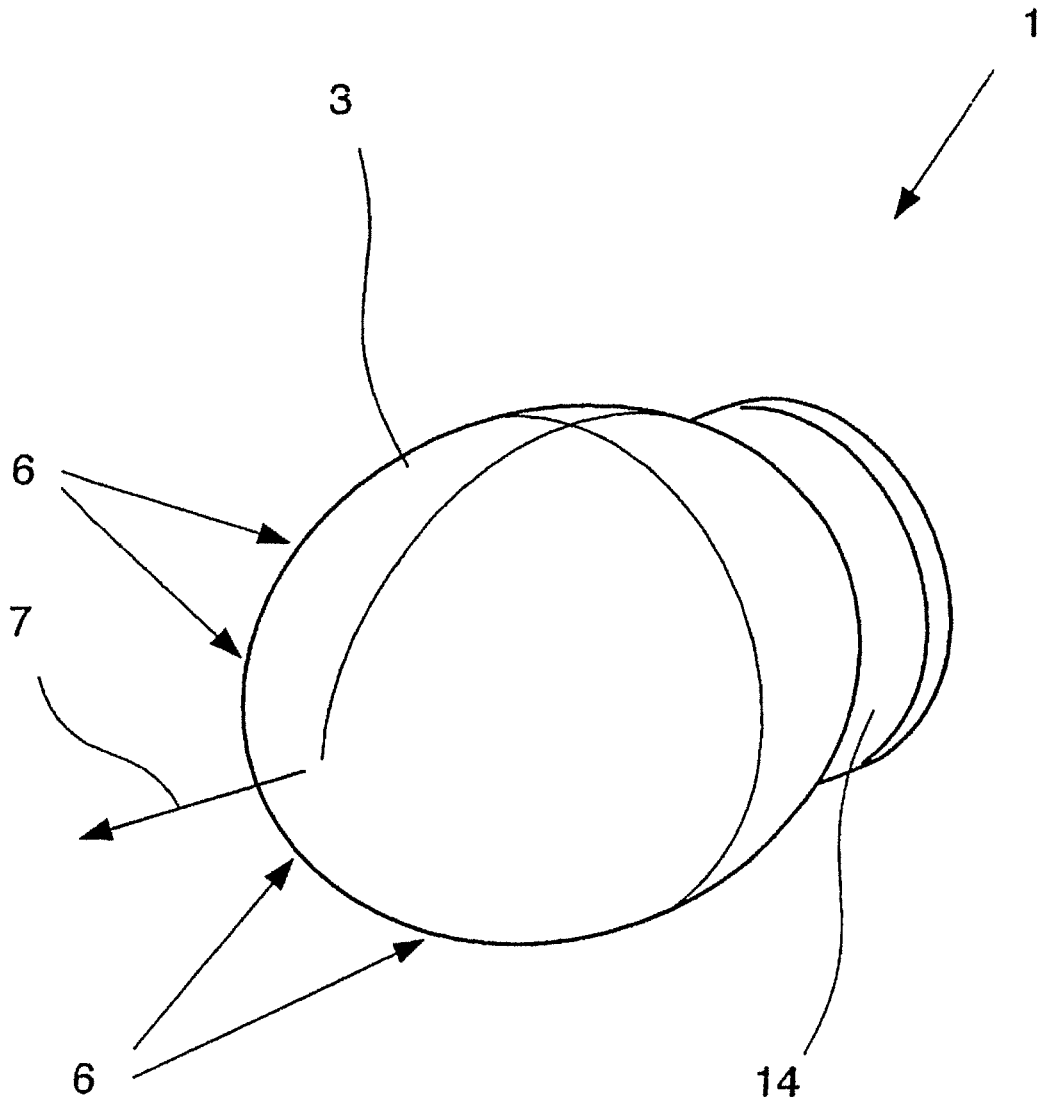
FIG. 3 is a schematic perspective view of a dielectric antenna in accordance with the invention.
Figure 4:
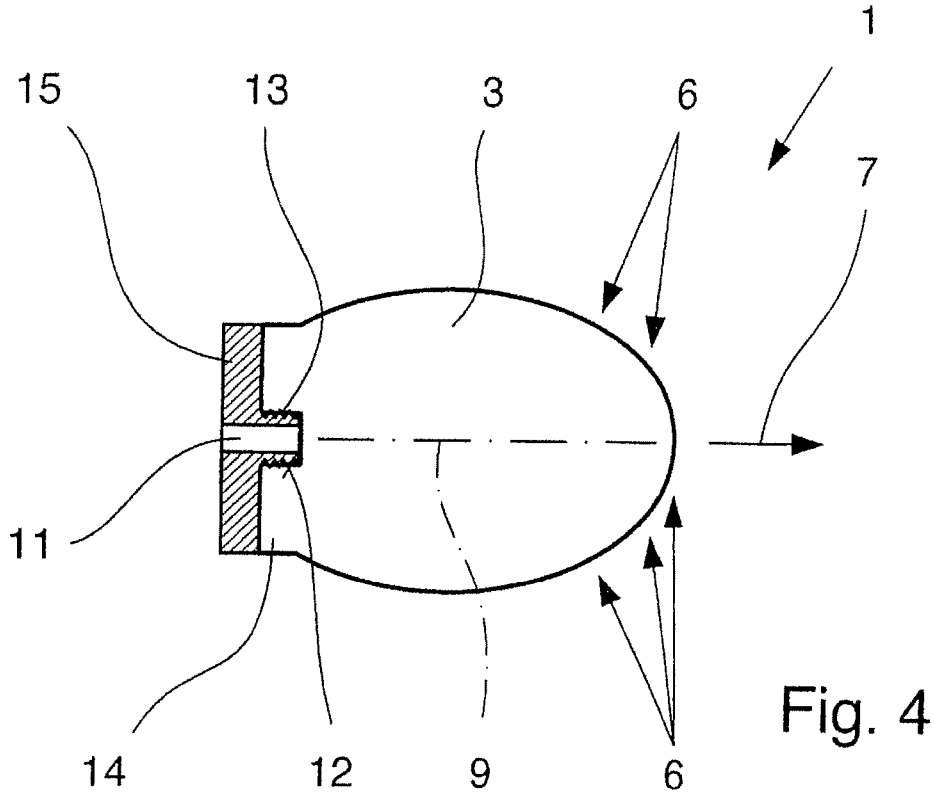
FIG. 4 is a schematic cross-sectional view of another exemplary embodiment of a dielectric antenna in accordance with the invention with a short, spout-like widening.

In all figures it is shown that the lens 3 is shaped ellipsoidally at least in the transmission region 6 and the lens 3 is arranged relative to the feed element 2 such that the electromagnetic radiation 4 emitted from the lens 3 in the direction of maximum radiation 7 of the antenna 1 has an essentially planar phase front 8, the phase front 8 being explicitly recognizable only in FIG. 2.

FIG. 1 clearly shows how the electromagnetic radiation 4 which has been emitted from the schematically shown feed element 2 propagates within the lens 3 and is refracted on the ellipsoidally shaped edging of the lens 3 in the transmission region 6 according to the laws of wave optics and is emitted essentially in the direction of maximum radiation 7 from the lens 3.

FIG. 2 shows especially clearly that essentially planar phase fronts 8 can be produced with the ellipsoidally shaped transmission region 6 of the lens 3 outside the lens 3 in the direction of the direction of maximum radiation 7; this is especially advantageous for a narrow radiation characteristic although the type of construction of the illustrated dielectric antennas 1 is very compact.

The dielectric antennas 1 shown in the figures have in common that the lens 3 is axisymmetrical to the major axis 9 of the ellipsoid which is defined by the at least ellipsoidally shaped transmission region 6 of the lens, the major axis 9 of the ellipsoid pointing essentially in the direction of maximum radiation 7 of the respectively shown antenna 1. Lenses 3 with this geometry can be especially easily produced, and therefore, have the desired properties with respect to the emitted electromagnetic radiation 4.

For other dielectric antennas which are not detailed here, the transmission region of the lenses defines several ellipses at a time whose major axes are aligned essentially coaxially. The ellipses then especially have one focal point essentially in common because in this way the desired properties of the emitted electromagnetic radiation can be achieved.

FIGS. 1 and 2 show especially well that the electromagnetic feed element 2 is located essentially at the focal point of the ellipsoid defined by the at least ellipsoidally shaped transmission region 6 of the lens 3 because the focal point property of the ellipsoidally shaped transmission region 6 of the lens 3 can be used especially advantageously in conjunction with the geometrical-optical refraction properties of electromagnetic radiation 4 on the edge of the lens 3 and on the dielectric step edge of the dielectric material of the lens 3 to the vicinity of the lens 3.

FIGS. 2 and 4 to 7 show that the electromagnetic feed element 2 comprises an electromagnetic radiation source 10 and a hollow conductor 11, the electromagnetic radiation 4 emitted by the radiation source 10 being routed from the hollow conductor 11 to the lens 3, the hollow conductor 11 being located essentially coaxially to the major axis 9 of the lens 3.

FIGS. 2 to 7 show those dielectric antennas 1 in which the lens 3 is attached to the outside 12 of the electromagnetic feed element 2 and on the outside 12 of the hollow conductor 11 and at least partially surrounds the electromagnetic feed element 2 and the hollow conductor 11. In the illustrated embodiments the lens 3 is screwed onto the hollow conductor 11. The advantages of this construction are obvious. On the one hand, mechanically very stable attachment of the lens 3 to the electromagnetic feed element 2 and to the hollow conductor 11 can be implemented in this way, in any case much more stable than is possible in the known designs in which the electromagnetic feed element 2 encompasses the lens 3 of the dielectric antenna 1. On the other hand, the antenna 1 can be very easily produced encapsulated in this way. Moreover the radiation properties of the illustrated dielectric antennas 1 are much better than in those dielectric antennas in which the lens 3 is partially surrounded by a metallic jacket, specifically the metallic jacket of the hollow conductor.

In FIGS. 1 to 6, the lenses 3 of the illustrated dielectric antennas 1 are made ellipsoidal essentially beginning from their feed region 5 in the direction of maximum radiation 7. The illustrated lenses 3 conversely are made spout-shaped opposite the direction of maximum radiation 7, specifically for holding the feed element 2 and the hollow conductor 11.

In FIGS. 2 to 4 and 6, the spout-like execution of the lens 3 is essentially cylindrical, the lens 3 being screwed completely onto the thread 13 and the part 14 of the lens 3 made spout-like encapsulating the antenna 1 on the process side. The encapsulation which is necessary especially for applications with increased hygiene requirements is achieved in that the part 14 of the lens 3 made spout-shaped essentially completely surrounds the electromagnetic feed element 2 and the hollow conductor 11.

Figure 5:
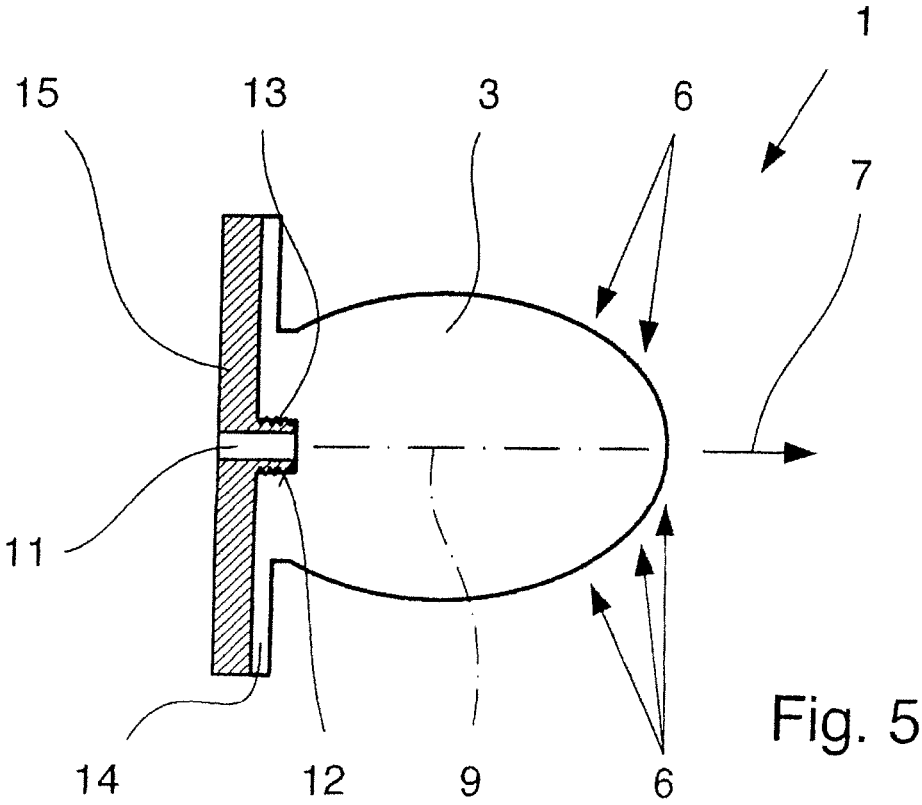
FIG. 5 is a schematic cross-sectional view of another exemplary embodiment of a dielectric antenna in accordance with the invention with a spout-like execution widened in the manner of a plate.
Figure 6:
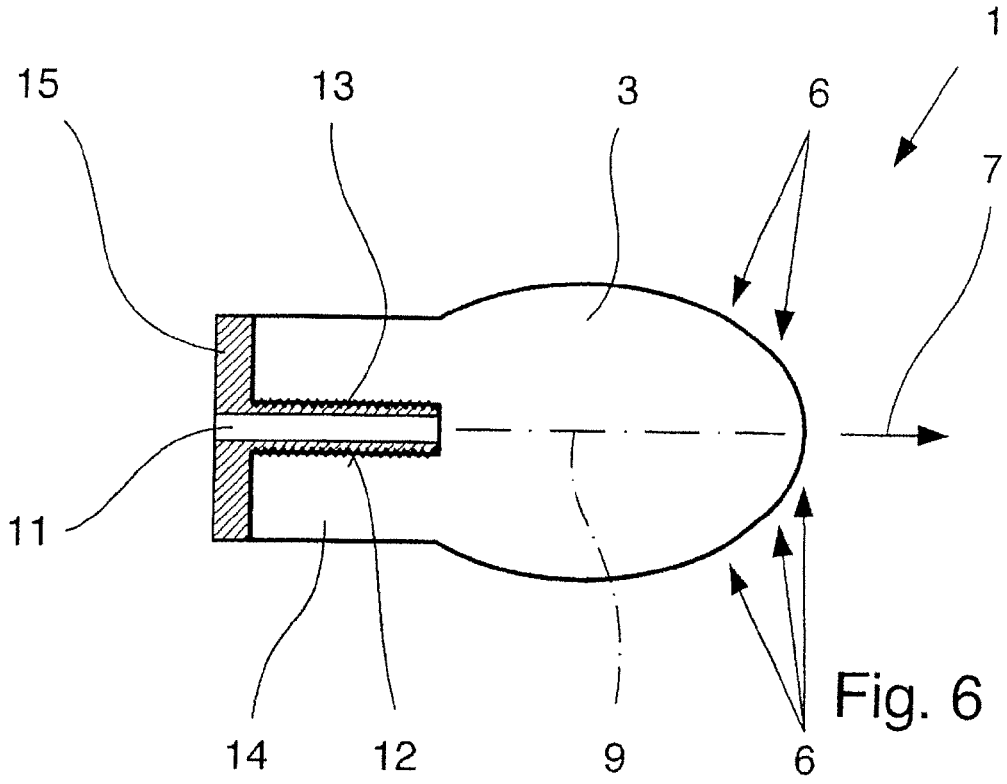
FIG. 6 is a schematic cross-sectional view of another exemplary embodiment of a dielectric antenna in accordance with the invention with a long, spout-shaped widening.

FIG. 5 shows that the part 14 made spout-shaped in the direction toward the metallic flange 15 is widened in the manner of a plate and largely covers the metallic flange 15. This is especially advantageous when the attachment elements (not shown) used for attachment of the metallic flange to the base are completely covered by the dielectric lens 3 of the antenna 1 after the lens 3 has been screwed onto the hollow conductor 11 by means of the thread 13.

Figure 7:
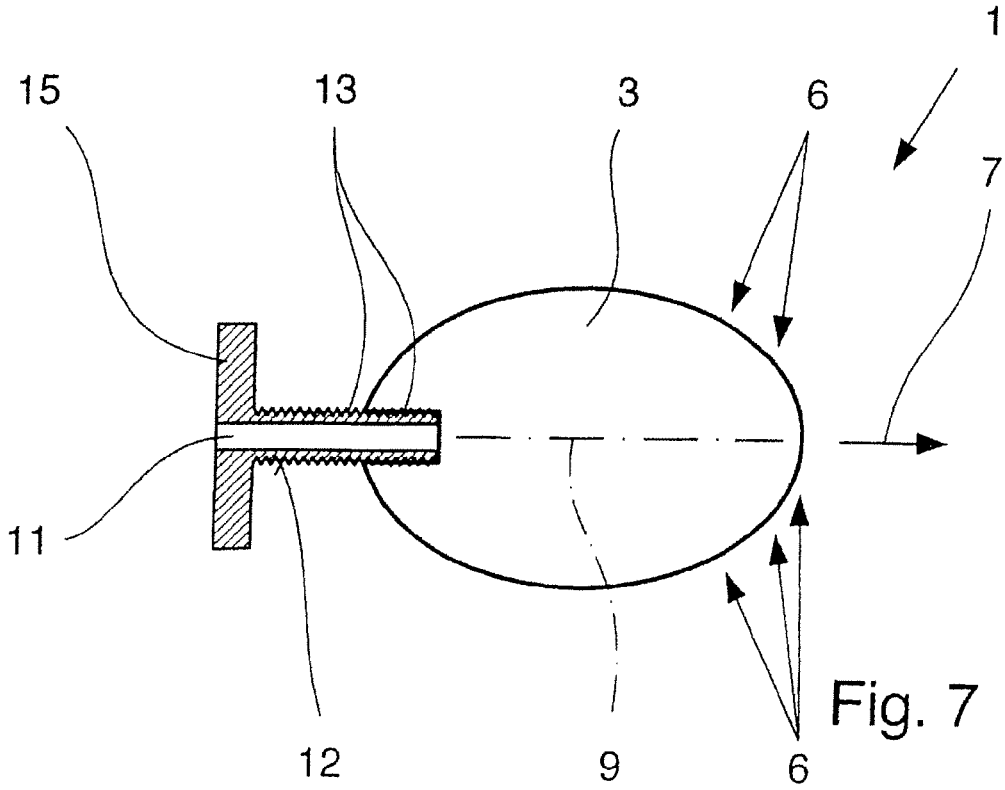
FIG. 7 shows one exemplary embodiment of a dielectric antenna in accordance with the invention, with a lens which has been made almost completely ellipsoidal.

The dielectric antenna 1 shown in FIG. 7 has a lens 3 which is made completely ellipsoidal except for the access region of the electromagnetic feed element 2 and of the hollow conductor 11.

What is claimed is:

1. Dielectric antenna, comprising:

an electromagnetic feed element emitting electromagnetic radiation and a lens made of a dielectric material, the lens being supplied with electromagnetic radiation in a feed region and relaying and radiating the electromagnetic radiation in a transmission region, wherein the lens is ellipsoidally shaped at least in the transmission region and the lens is arranged relative to the feed element such that the electromagnetic radiation emitted by the lens has an essentially planar phase front in a direction of maximum radiation of the antenna, wherein the electromagnetic feed element is located essentially at a focal point of the ellipsoid defined by the at least ellipsoidally shaped transmission region of the lens, wherein the electromagnetic feed element comprises a hollow conductor, the hollow conductor being located coaxially relative to the major axis of the lens, wherein the lens is ellipsoidal beginning essentially with the feed region thereof in the direction of maximum radiation and has a projecting spout-shaped part facing opposite the direction of maximum radiation, wherein the lens is attached to the outside of the hollow conductor, the spout-shaped part of the lens surrounding the outside of the hollow conductor, and wherein the spout-shaped part of the lens is formed as a cylindrical extension of the ellipsoidally shaped transmission region that is screwed onto a thread of the hollow conductor.

2. Dielectric antenna as claimed in claim 1, wherein the lens is axisymmetrical to a major axis of the ellipsoid defined by the at least ellipsoidally shaped transmission region of the lens, the major axis of the ellipsoid being directed essentially in the direction of maximum radiation of the antenna.

3. Dielectric antenna as claimed in claim 1, wherein the lens is ellipsoidal except for an access region for the electromagnetic feed element.

4. Dielectric antenna, comprising:

an electromagnetic feed element emitting electromagnetic radiation and a lens made of a dielectric material, the lens being supplied with electromagnetic radiation in a feed region and relaying and radiating the electromagnetic radiation in a transmission region, wherein the lens is ellipsoidally shaped at least in the transmission region and the lens is arranged relative to the feed element such that the electromagnetic radiation emitted by the lens has an essentially planar phase front in a direction of maximum radiation of the ante nna, wherein the electromagnetic feed element is located essentially at a focal point of the ellipsoid defined by the at least ellipsoidally shaped transmission region of the lens, wherein the electromagnetic feed element comprises a hollow conductor, the hollow conductor being located coaxially relative to the major axis of the lens, wherein the lens is ellipsoidal beginning essentially with the feed region thereof in the direction of maximum radiation and has a projecting spout-shaped part facing opposite the direction of maximum radiation, wherein the lens is attached to the outside of the hollow conductor with the spout-shaped part of the lens surrounding the outside of the hollow conductor wherein the electromagnetic feed element further comprises a plate-shaped flange from which the hollow conductor projects in a direction of maximum radiation of the antenna and wherein the spout-shaped part of the lens ends on the plate-shaped flange in a manner that at least partially covers said flange.

* * * * *